US009279555B2

(12) United States Patent
Bassett

(10) Patent No.: US 9,279,555 B2
(45) Date of Patent: Mar. 8, 2016

(54) CYCLONIC SEPARATOR

(75) Inventor: Alexander Anthony Denny Bassett, Suzhou (CN)

(73) Assignee: Hoover Limited (GB)

( * ) Notice: Subject to any disclaimer, the term of this patent is extended or adjusted under 35 U.S.C. 154(b) by 982 days.

(21) Appl. No.: 13/361,712

(22) Filed: Jan. 30, 2012

(65) Prior Publication Data

US 2012/0192378 A1 Aug. 2, 2012

(30) Foreign Application Priority Data

Jan. 31, 2011 (GB) ..... 1101623.5

(51) Int. Cl.

| | |
|---|---|
| ***A47L 9/20*** | (2006.01) |
| ***F21S 13/00*** | (2006.01) |
| ***A47L 9/10*** | (2006.01) |
| ***A47L 9/16*** | (2006.01) |
| *F21W 101/02* | (2006.01) |

(52) U.S. Cl.

CPC ..... *F21S 13/00* (2013.01); *A47L 9/108* (2013.01); *A47L 9/1666* (2013.01); *A47L 9/1683* (2013.01); *F21W 2101/02* (2013.01)

(58) Field of Classification Search

CPC ..... A47L 9/108; A47L 9/1666; A47L 9/1683; F21S 13/00; F21W 2101/02

USPC ..... 15/352, 353; 55/393, 399, 430, 432, 55/315

IPC ..... A47L 9/108

See application file for complete search history.

(56) References Cited

U.S. PATENT DOCUMENTS

| | | | | |
|---|---|---|---|---|
| 4,162,148 | A * | 7/1979 | Furstenberg | 96/425 |
| 4,318,721 | A * | 3/1982 | Barr | 55/337 |
| 4,363,156 | A * | 12/1982 | Leinfelt | 15/327.1 |
| 2004/0055263 | A1 * | 3/2004 | Sjorberg et al. | 55/430 |
| 2005/0125943 | A1 * | 6/2005 | Sjoberg et al. | 15/404 |

FOREIGN PATENT DOCUMENTS

| | | |
|---|---|---|
| DE | 3717333 | 5/1987 |
| DE | 3825773 | 2/1990 |
| DE | 4218851 A1 | 6/1992 |
| EP | 1023864 A2 | 8/2000 |

(Continued)

OTHER PUBLICATIONS

UK Intellectual Property Office, Search Report under Section 17, GB1101623.5, May 16, 2011, 2 pages.

(Continued)

*Primary Examiner* — David Redding
(74) *Attorney, Agent, or Firm* — Kang S. Lim

(57) ABSTRACT

A vacuum cleaner incorporating a cyclone separation device comprises a cylindrical cyclone chamber having a tubular side wall in the form of a filter. An auger is mounted within the chamber for rotation about the longitudinal axis thereof, the auger having a vane which extends along the chamber in a first helical direction. In use, the auger is rotated in a direction opposite to said helical direction so that separated dirt and dust is driven to a collection region at the bottom of the chamber and compacted. The collection region preferably expands during use to increase the capacity thereof. A vacuum cleaner in accordance with the invention has to be emptied less regularly and any risk of dust re-entrainment is reduced.

30 Claims, 9 Drawing Sheets

(56) References Cited

FOREIGN PATENT DOCUMENTS

| | | | | |
|---|---|---|---|---|
| GB | 2369290 | | | 5/2002 |
| JP | 2010119623 | A | | 11/2008 |
| JP | 2010-119623 | | * | 6/2010 |
| KR | 100842963 | B1 | | 7/2007 |
| TW | 509732 | B | | 11/2002 |
| WO | WO00/06816 | | * | 2/2000 |
| WO | WO 00/49932 | A1 | | 8/2000 |

OTHER PUBLICATIONS

The State Intellectual Property Office of the People's Republic of China, First Office Action, Jun. 3, 2015, 3 pages.

* cited by examiner

CYCLONIC SEPARATOR

CROSS REFERENCE TO RELATED APPLICATIONS

This application claims the benefit of United Kingdom Patent Application No. 1101623.5 filed Jan. 31, 2011, which application is incorporated herein in its entirety by this reference.

BACKGROUND

This invention relates to a cyclone separator and to a vacuum cleaner incorporating the same.

Vacuum cleaners all incorporate some form of dust separation apparatus to separate dirt and dust from an induced airflow. Historically, vacuum cleaners were provided with porous filter bags which filter and collect the dust. Once full, the dust bag can be discarded and replaced.

Nowadays it has become fashionable to provide vacuum cleaners with cyclonic separators which can simply be emptied without the need to purchase dust bags. Cyclonic separators also avoid the problem that dust bags can become clogged with dust if they are not changed regularly. A disadvantage of such cyclonic vacuum cleaners is that the dirt and dust collected at the bottom of the cyclone chamber can become re-entrained into the airflow if too much separated dirt and dust accumulates at the bottom of the chamber. Accordingly such cleaners have a limited capacity for separated dirt and dust and need to be emptied regularly.

Another disadvantage known to cyclonic vacuum cleaners is that the separated dirt and dust is simply emptied by removing the collection chamber from the cleaner and opening a flap or turning the chamber upside-down. The dirt and dust then falls under gravity into a refuse receptacle. This process is both messy and unhygienic.

Various solutions to the above mentioned problems have been proposed. DE3825773 discloses a vacuum cleaner comprising a cyclonic separation chamber in which dirt and dust separated from the airflow collects in the base of the cyclonic separation chamber and is then conveyed into a detachable dirt receptacle by a horizontally-disposed auger driven by an electric motor.

DE3717333 discloses a cyclonic vacuum cleaner separator incorporating a horizontal auger at the base of the separation chamber, whereby the auger drives the separated dirt into a cylindrical compaction chamber closed at its downstream end by a spring-loaded flap. The spring-loaded flap is forced open by the accumulated compacted dirt, whereupon cakes of dirt are ejected into a container, typically a bag, for disposal. A problem with this cleaner is that fibrous matter such as fluff and hair is not drawn into the auger with the result that it accumulates in the separation chamber and affects the cyclonic separation action and eventually causes a blockage.

EP1023864 discloses an upright cyclonic vacuum cleaner having a separator unit with a low-efficiency cyclonic separation chamber providing the first stage of separation. Partly-cleaned air exits the cyclone chamber through an axially-orientated cylindrical perforated pre-filter, within which is located a cylindrical pleated high-efficiency filter providing a second filtration stage. The pre-filter can be rotated about its axis by a manually-operated handle, and has on its external surface a helical ramp arranged to act as an auger. The interior of the pre-filter has a pair of radially-inward projecting resilient ribs which engage the pleats of the stage-2 filter. Thus, when the pre-filter is rotated, following use of the cleaner, or during emptying through a pivoted base flap, both the pre-filter and the stage-2 filter are vibrated due to contact of the ribs with the pleats of the stage-2 filter. Accumulated fine dust is thus shaken off their surfaces. At the same time, the helical ramp on the external surface of the pre-filter tends to propel accumulated coarse dirt downwards in the cyclone chamber, thus compacting the dirt at the base of the chamber.

SUMMARY

To achieve the foregoing and in accordance with the present invention, we have now devised an improved cyclone separator.

In accordance with the present invention, there is provided a cyclone separation apparatus for separating matter from a flow of fluid, the apparatus comprising:

a cylindrical cyclone chamber having a tubular side wall;

an inlet disposed at a first end of the chamber for the fluid to be treated;

a region disposed at the second end of the chamber for collecting matter separated from the fluid;

an auger mounted within the chamber for rotation about the longitudinal axis thereof, the auger having a vane which extends both radially of the chamber and longitudinally of the chamber towards the second end thereof in a first helical direction; and means for rotating the auger about the longitudinal axis of the chamber in a direction opposite to said helical direction.

In use, the auger is rotated to drive matter separated from the fluid in the chamber into said region: the direction of rotation of the auger is opposite to the helical direction and thus the separated matter in the region is compacted and thus the capacity of the separator for separated matter is substantially increased. In this manner, the separator has to be emptied less regularly and the risk of re-entrainment of the separated matter is reduced. The separated dirt and dust is compacted and, as such, the cleaner is more hygienic and cleaner to empty.

Preferably the apparatus is arranged such that fluid flows helically within the chamber between adjacent turns of said helically-extending vane.

Preferably the auger is driven at the same time as fluid flows through the cyclone chamber.

Preferably the radially outer edge of the vane engages the internal surface of the tubular side wall of the chamber, such that the vane acts to dislodge any separated matter accumulated thereon.

Preferably the radially outer edge of the vane comprises a resilient member biased against the internal surface of the tubular side wall of the chamber. The member is preferably formed of a metal such as sprung steel. Alternatively or additionally, the member may be biased radially outwardly by a biasing member.

Preferably one or more apertures or openings are provided in the tubular side wall to form a fluid outlet from the cyclone chamber.

Preferably the tubular side wall defines a filter through which fluid flows radially out of the cyclone chamber, said filter being provided with a plurality of said apertures or openings. Preferably the auger is arranged to engage the internal surface of the filter to clean the latter and to drive the accumulated matter towards said region for collection.

Preferably the area of the filter is small compared with the area of the tubular side wall in order to create a significant pressure drop across the filter and to thereby hold the separated dirt and dust against the filter. In this way, the general tendency for the separated dirt and dust to rotate with the auger is resisted and the dirt and dust will be driven downwards by the thread of the auger for collection and compaction.

Preferably the filter extends axially of the tubular side wall between opposite ends of the cyclone chamber.

Preferably the cyclone chamber comprises an end wall at the second end thereof against which the separated matter collects, said end wall being moveable away from said auger to expand the volume of said region. In this manner, the capacity of the separator for separated matter is further increased.

Preferably said end wall is biased towards the auger and is arranged to move away from the auger against said bias as the region fills with separated matter.

Preferably said end wall is biased towards the auger by a reduced fluid pressure inside said chamber when the apparatus is in use.

Preferably the apparatus comprises an outer tubular wall mounted co-axially with the tubular side wall of the cyclone chamber, said end wall being mounted to the outer tubular wall at said second end of the cyclone chamber, the outer tubular wall being moveable axially of the tubular side wall of the cyclone chamber.

Preferably said one or more apertures or openings in the tubular side wall communicate with a space defined between the tubular side wall of the cyclone chamber and a further tubular wall disposed radially outwardly thereof.

Preferably said space conveys fluid from the cyclone chamber to a downstream separation device arranged to remove finer matter from the fluid.

Preferably said downstream separation device is disposed axially outwardly of said first end of the cyclone chamber.

Preferably means are provided for collecting matter separated by said downstream separation device.

Preferably said collection means comprises a duct extending along the central axis of the auger to said second end of the cyclone chamber and arranged so that the matter separated by said downstream separation device is collected in said region together with matter separated in the cyclone chamber.

Preferably a valve is provided for closing said duct when the device is in use so as to prevent the flow of fluid from the chamber and along said duct to the downstream separation device and thereby bypassing the filter or aperture(s) or opening(s).

The compacted dirt and dust may be collected in a disposable receptacle such as bag. Alternatively, the cleaner may carry a disposable receptacle such as bag, the cleaner being arranged to release the compacted dirt and dust into said bag during emptying.

Also, in accordance with the present invention, there is provided a vacuum cleaner incorporating a cyclone separation apparatus as hereinbefore defined.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

Embodiments of the present invention will now be described by a way of examples only and with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Figure 1:
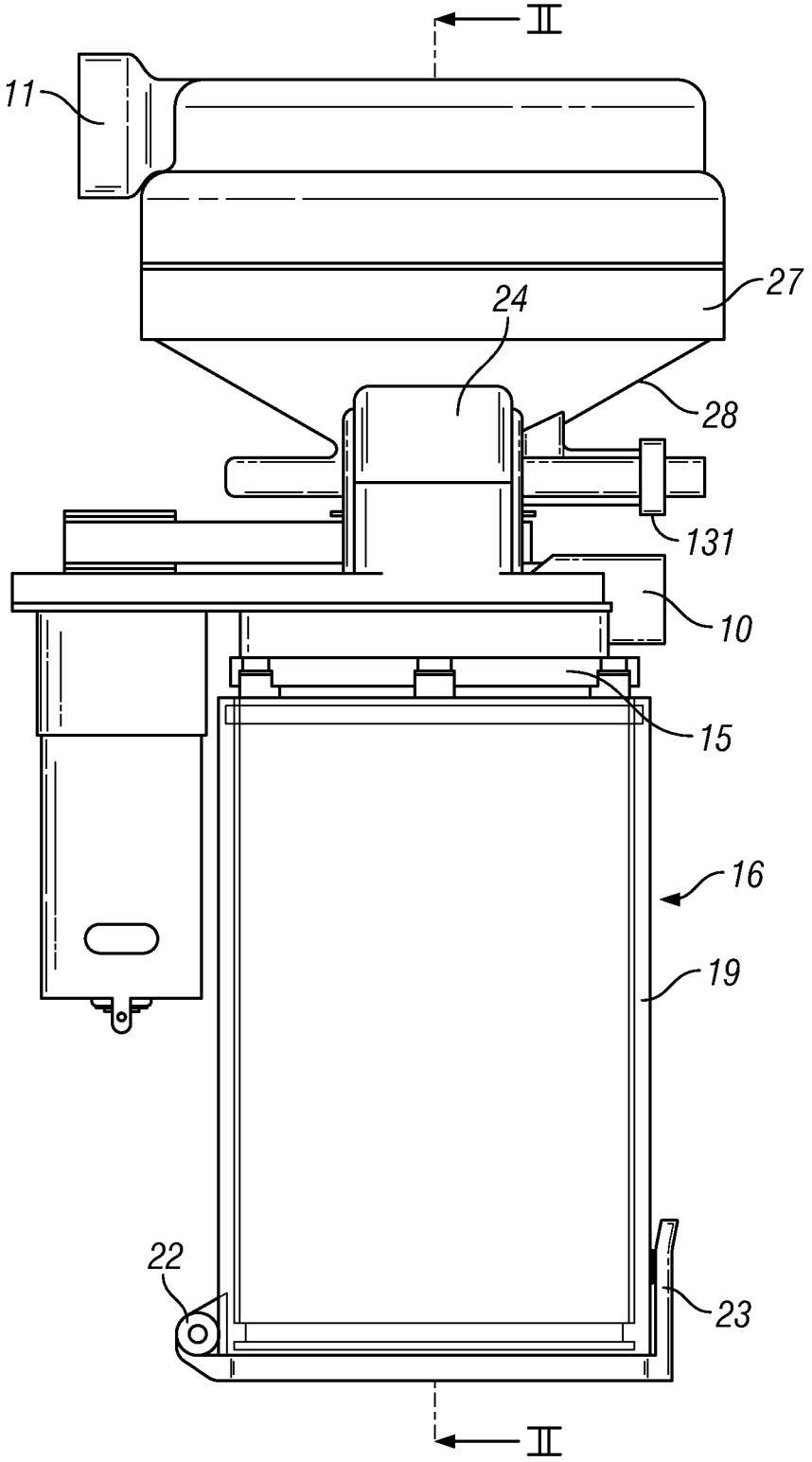
FIG. 1 is a side view of a dust separation unit of an embodiment of vacuum cleaner in accordance with the present invention.
Figure 2:
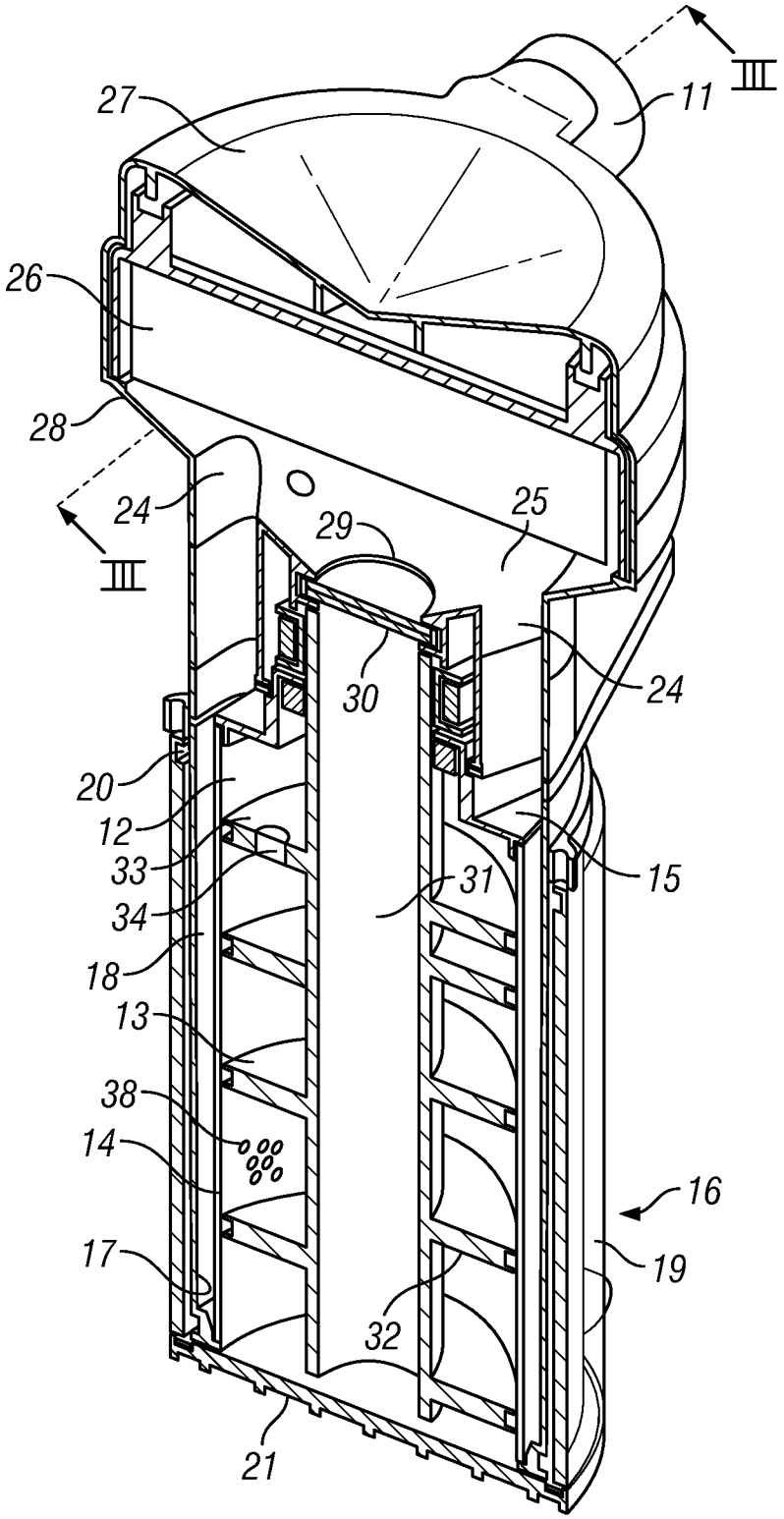
FIG. 2 is a sectional isometric view along the line II-II of FIG. 1.
Figure 3:
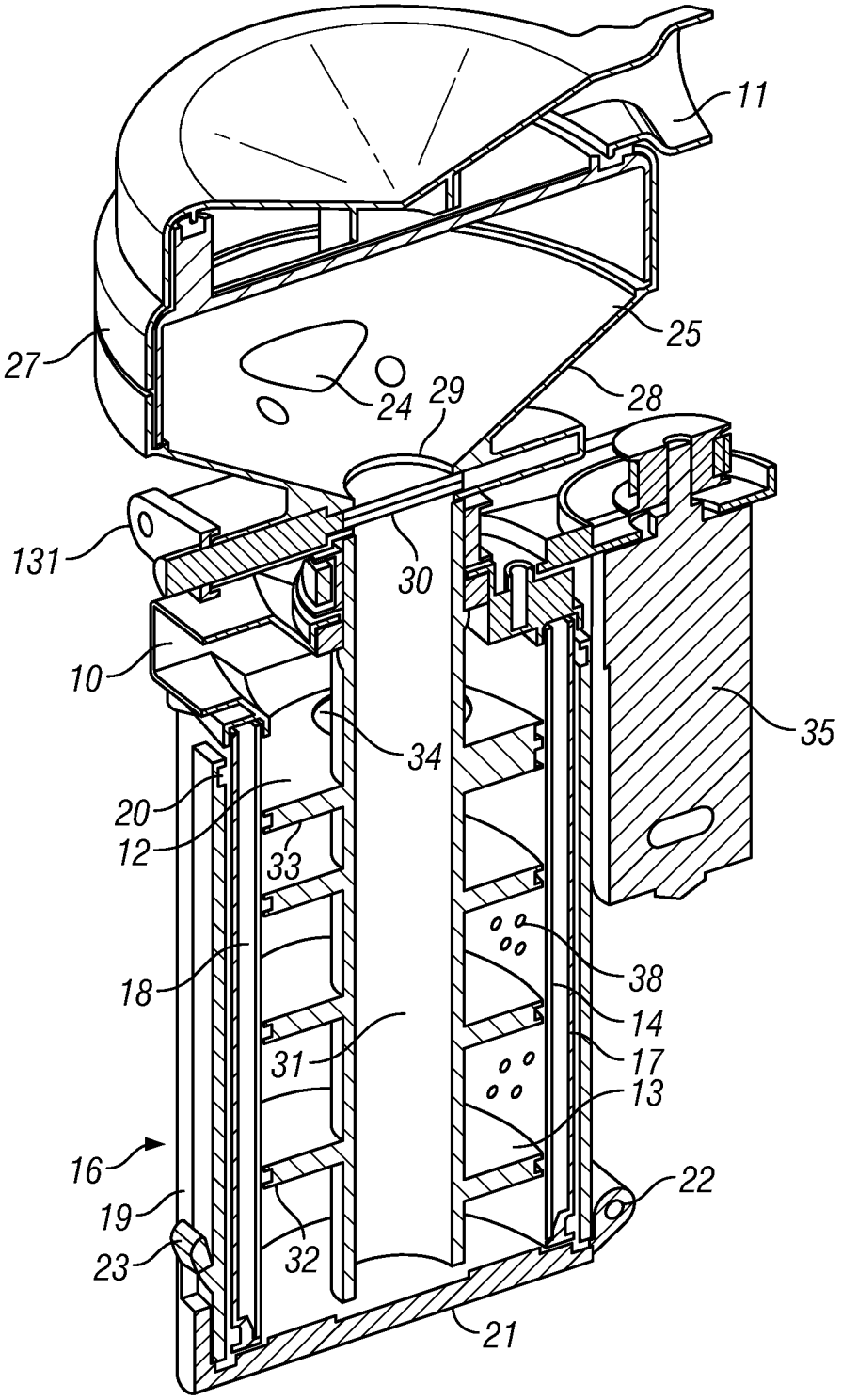
FIG. 3 is a sectional isometric view along the line III-III of FIG. 2.

Referring to FIGS. 1 to 3 of the drawings, there is shown a dust separation unit of a vacuum cleaner having a dirty air inlet port 10 and an outlet port 11 for cleaned air. The inlet port 10 extends through the upper end wall 15 of a cyclone separator device 16 mounted at the lower end of the unit. The cyclone separator 16 comprises a cylindrical cyclone chamber 12 having a tubular side wall 14 in the form of a filter, which is provided with a plurality of apertures or openings 38 that allow air to pass therethrough but which serve to block the passage of particles having a size greater than a predetermined limit, e.g. 0.4 mm. The side wall 14 is preferably formed of a metal, such as stainless steel in which apertures or openings 38 of the required size are formed, e.g. using laser cutting or chemical etching.

The tubular side wall or filter 14 is disposed inside a tubular body 17 mounted co-axially therewith and separated therefrom by an annular space 18. The cyclone separator 16 further comprises a tubular outer wall 19 which is a tight but sliding fit around the tubular body 17. The upper end of the tubular outer wall 19 is provided with an inwardly directed seal 20, which lightly seals against the exterior surface of the tubular body 17. The lower end of the tubular outer wall 19 is provided with a flap or closure 21, which serves to form a bottom end wall of the cyclone chamber 12. The flap 21 is connected to the tubular outer wall 19 by a hinge 22. A catch 23 is provided for retaining the flap 21 in its closed position.

The upper end of the annular space 18 is connected via a plurality of parallel ducts 24 to a circular-section filter chamber 25 disposed axially above the cyclone separator 16. A circular-section filter 26 (not shown in FIG. 3) is mounted co-axially inside the chamber 25 above the ducts 24. The outlet port 11 of the device extends from a region of the chamber 25 disposed above the filter 26. The filter chamber 25 comprises a filter housing 27, which can be opened to gain access to the filter 26 therein.

The housing 27 comprises a frusto-conical bottom wall 28 which tapers inwardly and downwardly towards an axially-disposed opening 29. A valve flap 30 is mounted across the opening 29 and can be slid between an open and a closed position by an actuator 131 disposed externally of the device.

An auger 13 is mounted inside the cyclone chamber 12 for rotation about the central longitudinal axis thereof. The auger 13 comprises a central axially-extending tubular shaft 31 and a vane 32 which extends helically around the exterior of the shaft 31 in a clockwise direction from the upper to the lower end thereof. In the example shown, the vane 31 has approximately four turns but it will be appreciated that more or less turns could be provided. The vane 32 extends radially outwardly from the shaft 31 to contact the interior surface of the tubular filter 14 of the side wall of the cyclone chamber 12. An annular collar 33 extends around the upper end of the shaft 31 and comprises a radially outer edge in contact with the tubular filter 14. The upper end of the vane 32 is connected to the underside of the collar 33. An aperture 34 is formed in the collar 33. A motor 35 is arranged to rotate the shaft 31 of the auger 13 about the central longitudinal axis of the cyclone chamber 12.

Figure 4:
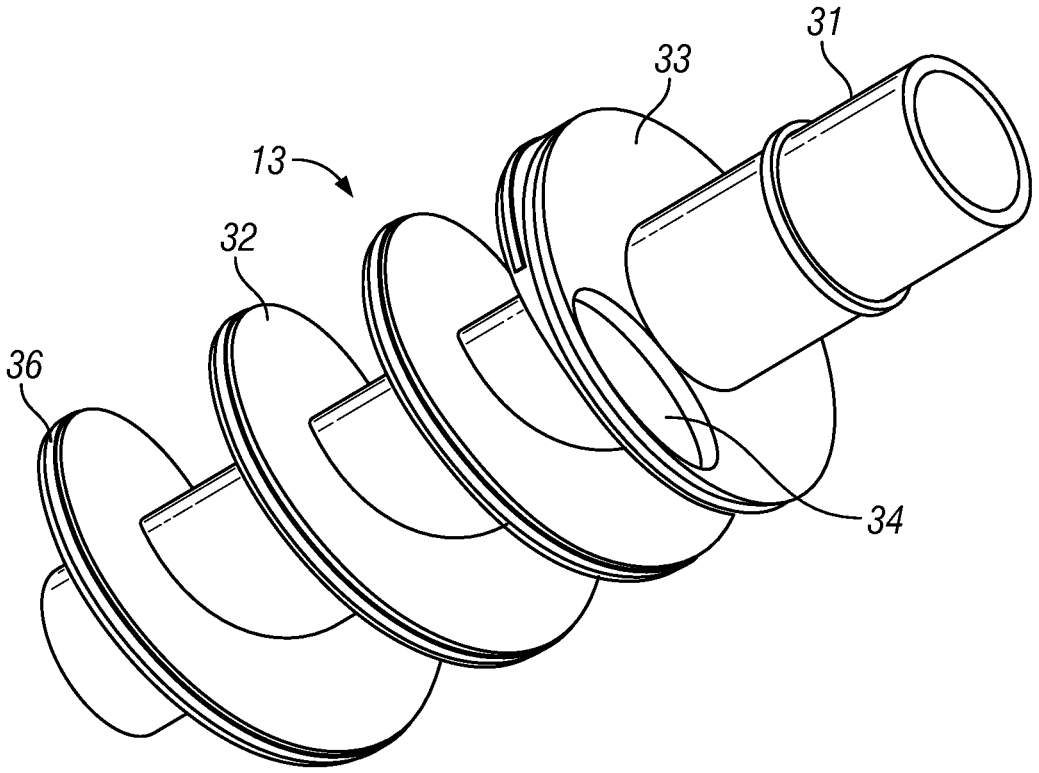
FIG. 4 is an isometric view of an auger of the unit of FIG. 1.
Figure 5:
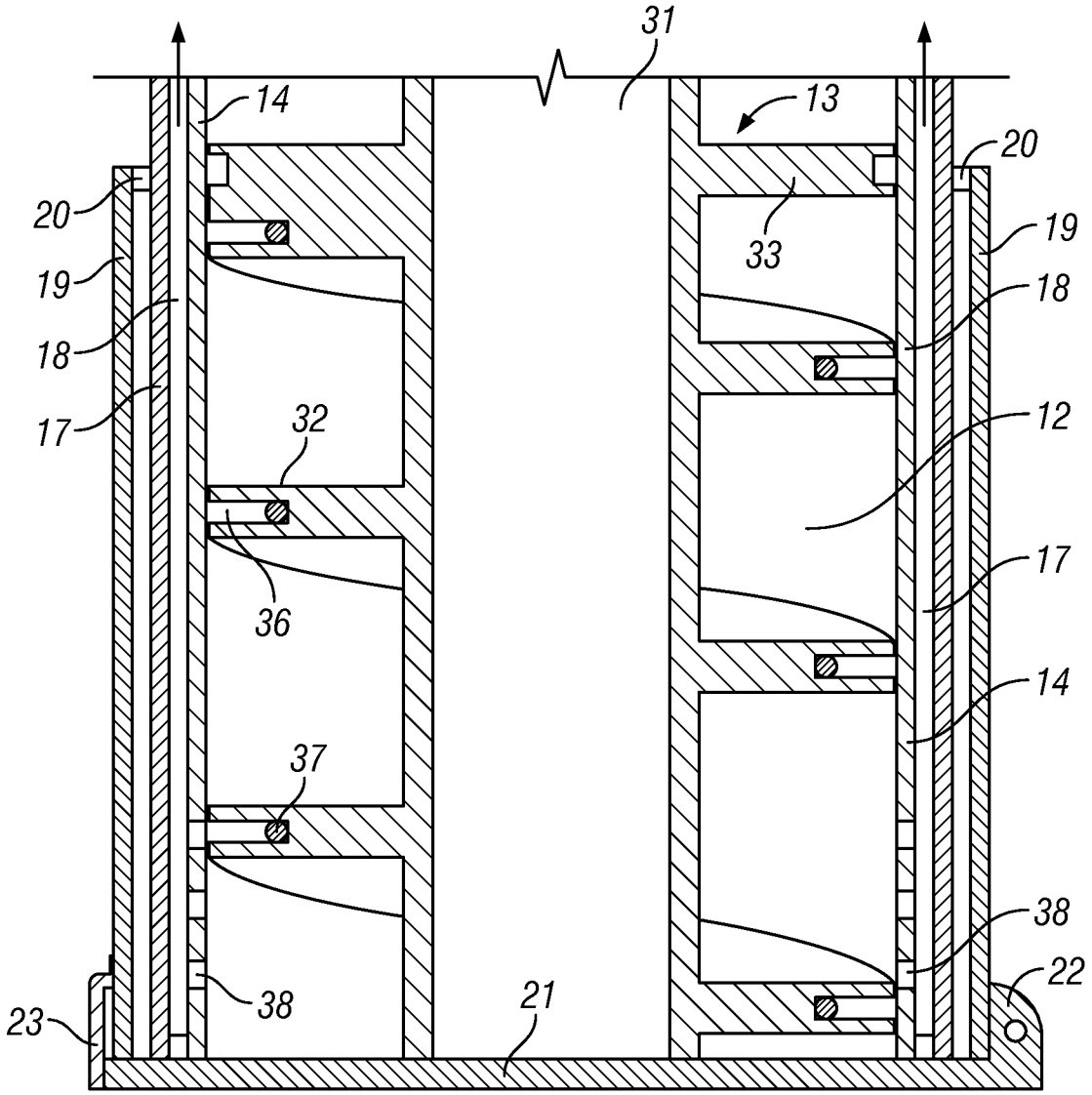
FIG. 5 is a longitudinal sectional view through a portion the auger of FIG. 4 when in situ.

Referring to FIGS. 4 and 5 of the drawings, the radially outer edge of the vane 32 is provided with a sealing member 36 in the form of a sprung steel strip, which is biased against the internal surface of the tubular filter 14 by an elastomeric member 37 disposed at the base of a channel in which the member 37 is mounted.

Figure 6:
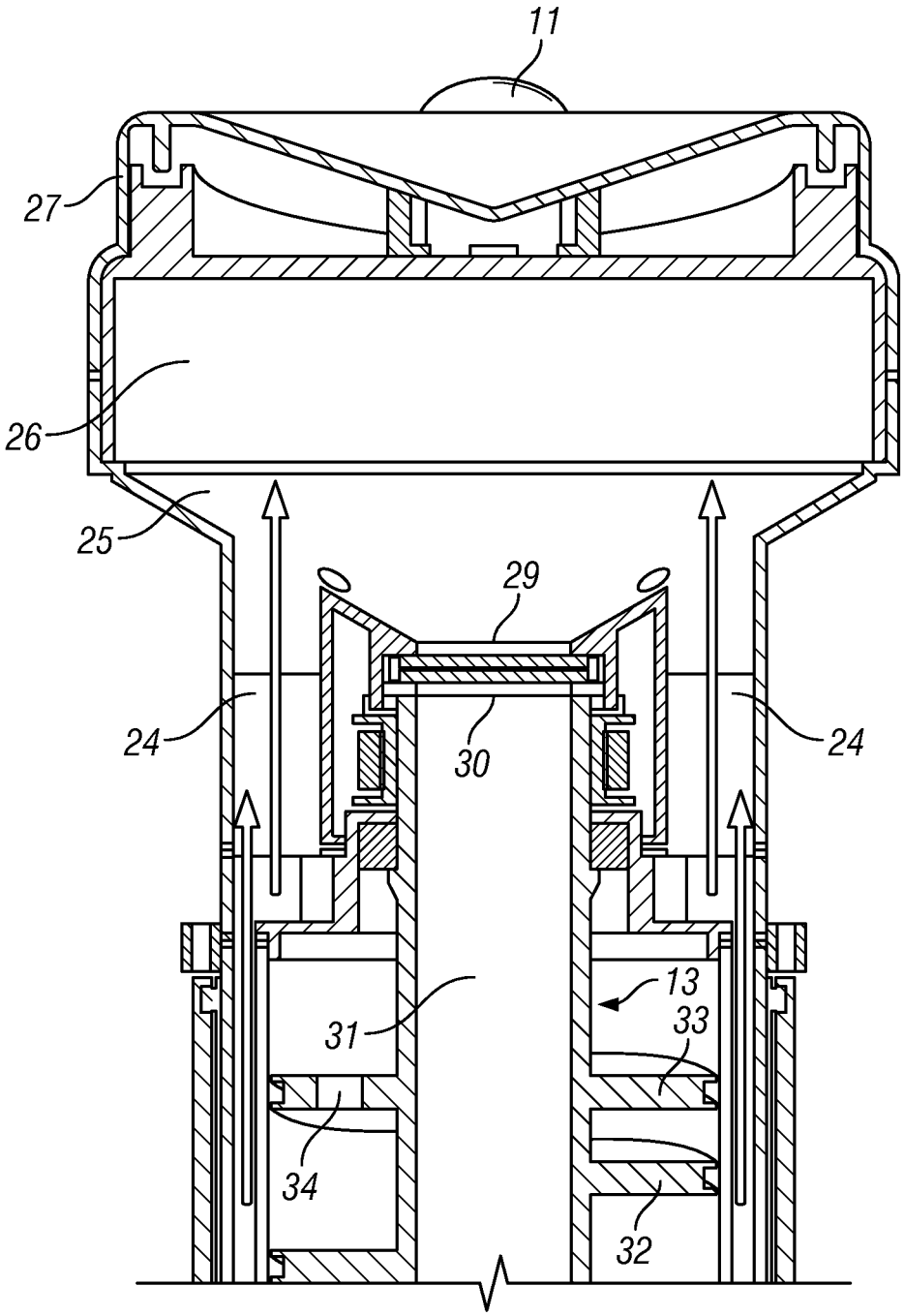
FIG. 6 is an enlarged sectional view of the upper portion of the unit of FIG. 1 depicting the airflow when in use.
Figure 7:
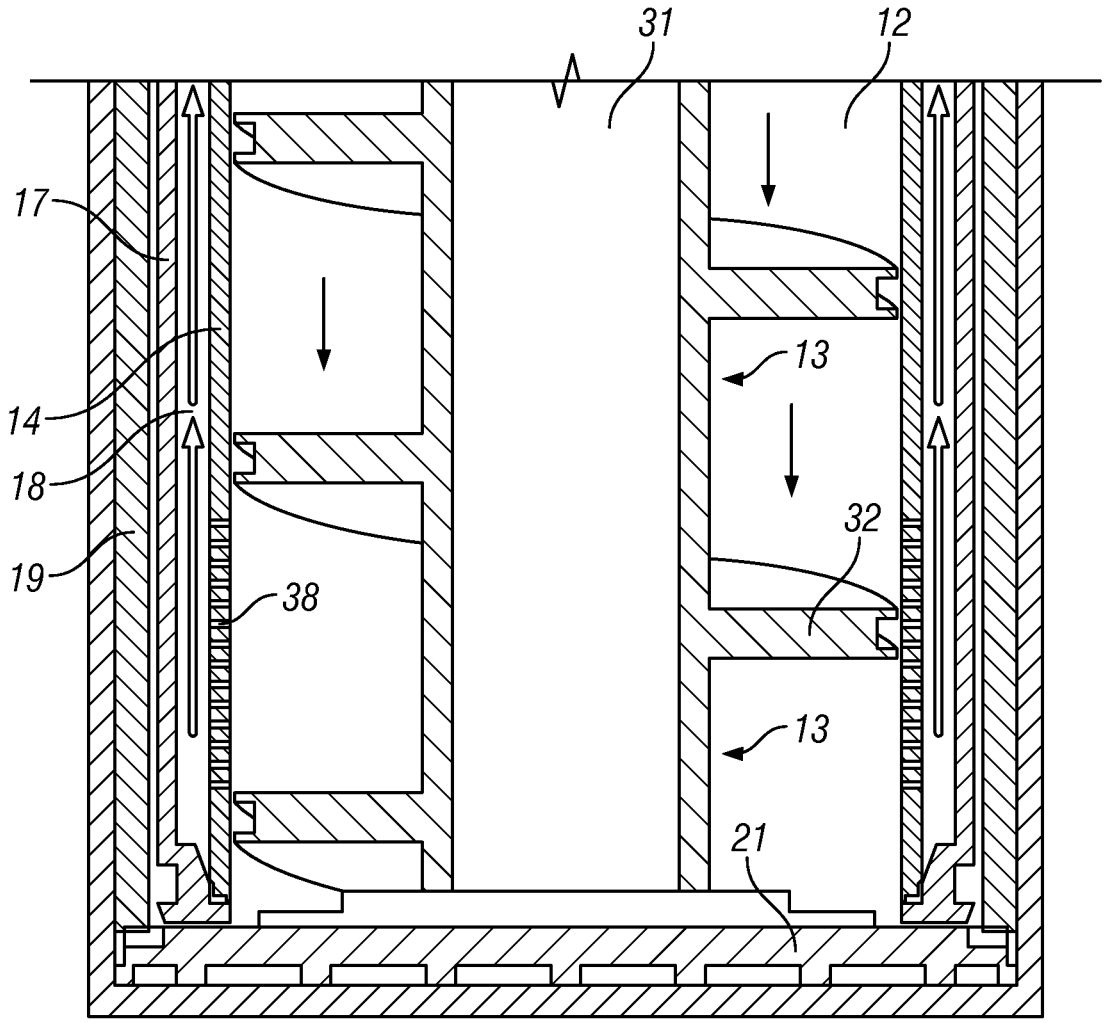
FIG. 7 is an enlarged sectional view of the lower portion of the unit of FIG. 1 depicting the airflow when in use.
Figure 8:
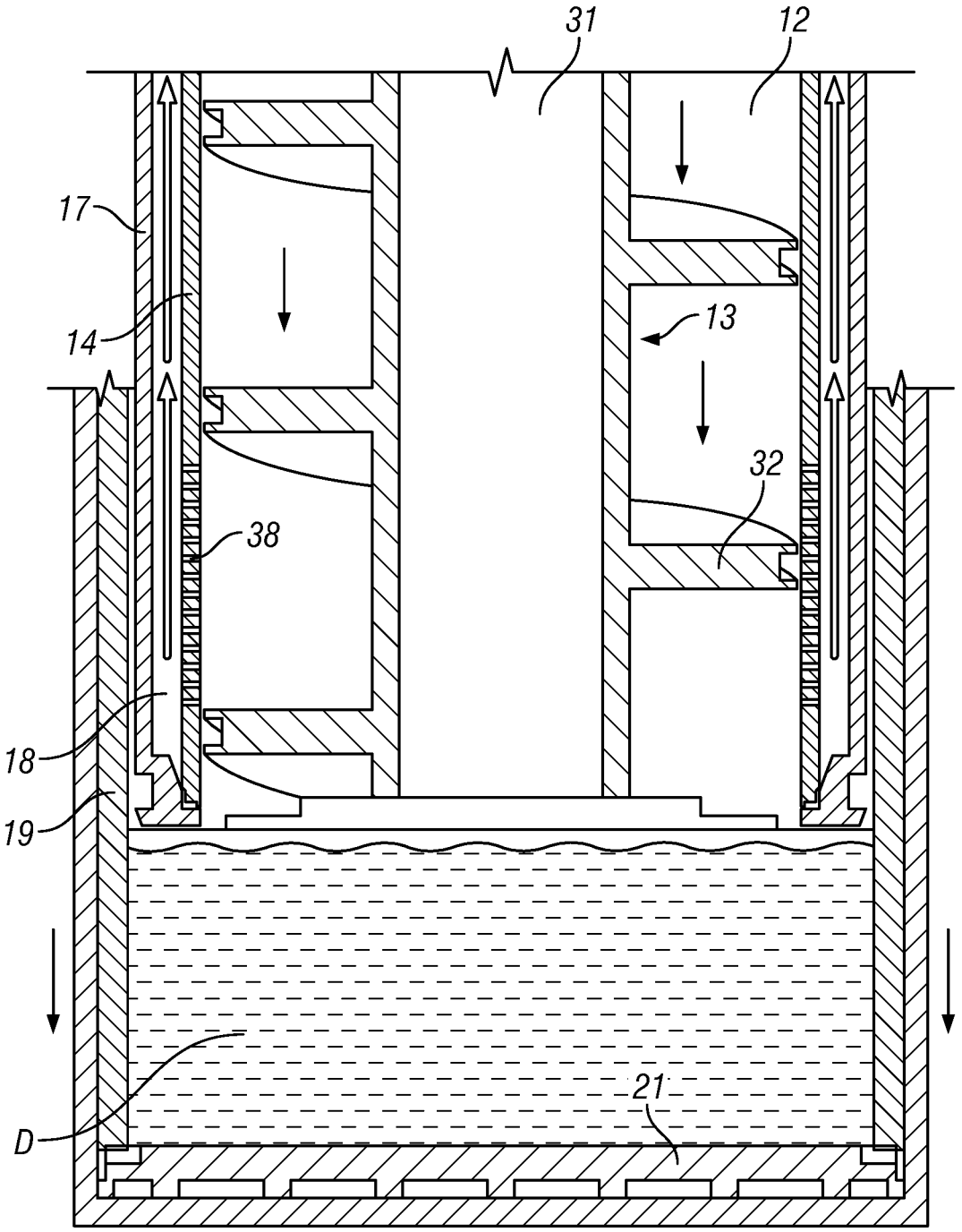
FIG. 8 is an enlarged sectional view of the lower portion of the unit of FIG. 1 when full of separated dust.

Referring to FIGS. 6 to 8 of the drawings, in use air is drawn into the inlet 10 of the unit by a motor/fan unit (not shown) mounted downstream of the outlet 11 of the unit. The inlet 10 is connected to a floor-engaging head of the vacuum cleaner, so that dust-laden air enters the cyclone chamber 12 via the inlet port 10. The motor 35 is actuated in order to rotate the auger 13 in the counter-clockwise direction (i.e., opposite to the direction in which the vane 32 is wound). Air entering the cyclone chamber 12 then passes through the aperture 34 in the collar 33 of the auger 13. The air then swirls between the adjacent turns of the vane 32 and it will be appreciated that particles contained in the airflow will be forced radially outwards against the tubular filter 14 in line with established cyclonic separation principles. Any dust or matter accumulated on the internal surface of the tubular filter 14 will be scoured and driven downwards by the edge 36 of the vane 32. As the air swirls around the rotating auger 13, it is constantly being drawn radially outwardly through the tubular filter 14 and into the space 18 inside the tubular body 17.

The cleaned air then travels upwardly in the space 18 and through the ducts 24 into the filter chamber 25. The air then passes through the filter 26 and out through the outlet 11. Any fine dust particles in the airflow leaving the cyclone chamber 12 are thus caught on the underside of the filter 26. In an alternative embodiment, one or further separation devices may be provided downstream of the cyclone separator 16 in addition to or instead of the filter 26.

During use, the auger 13 is constantly driven to drive any dirt and dust collected within a cyclone chamber 12 towards the lower end thereof. As the volume of the separated matter D increases, the auger 13 acts to force it against the flap 21 at the bottom end of the cyclone chamber 12. The tubular outer wall 19 then moves downwardly as the force applied to the flap 21 increases. In this manner, the volume available at the bottom of the cyclone chamber 12 for holding the separated matter increases. The reduced pressure inside the cyclone chamber 12 has a tendency to pull the flap 21 upwardly towards the auger 13, thereby maintaining the compactness of the unit and assisting compaction.

During use, the valve flap 30 is closed to prevent the passage of air along the central duct 31 of the auger 13 towards the filter 26. Following use, the actuator 131 can be operated to open the flap 30 and allow dust which has fallen from the underside of the filter 26 to fall through the opening 29 and along the auger duct 31 towards the bottom of the cyclone chamber 12. In this manner, dust collected on the filter 26 is collected along with the dust separated by the cyclone unit 60. The dirt and dust can then be emptied by opening the flap 21.

Figure 9:
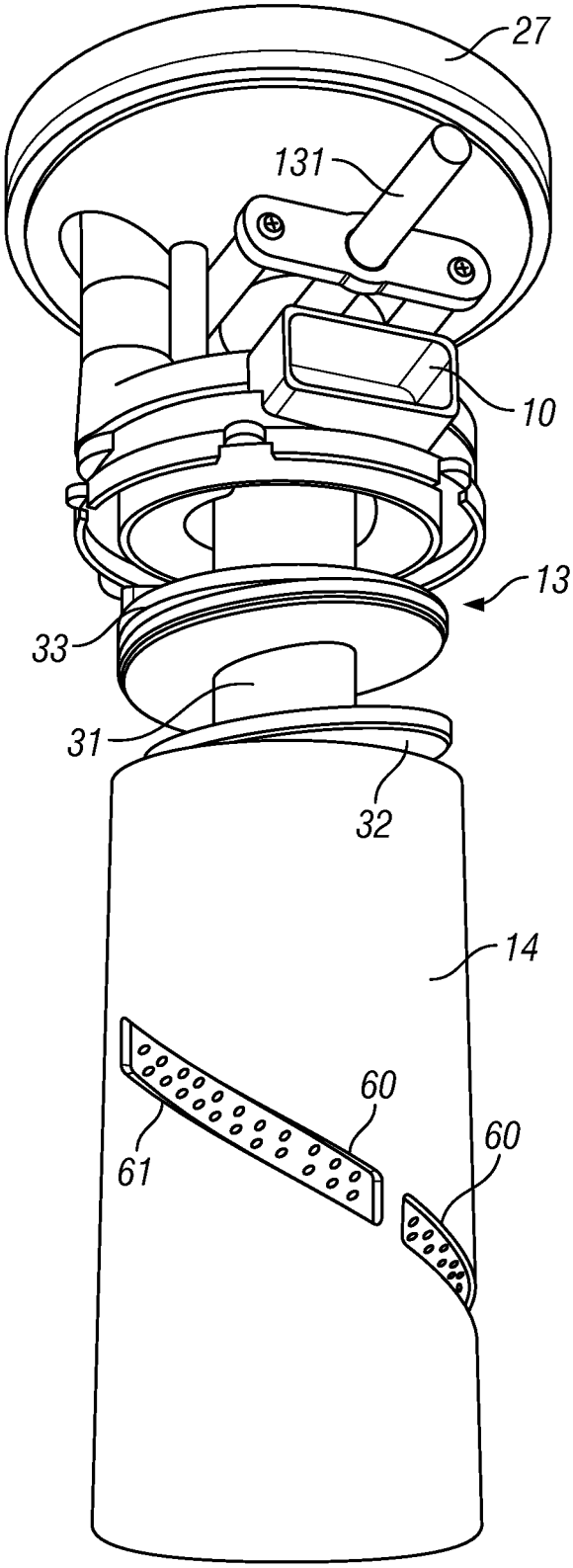
FIG. 9 is an exploded isometric view of a dust separation unit of an alternative embodiment of vacuum cleaner in accordance with the present invention.

Referring to FIG. 9 of the drawings, there is shown a dust separation unit of an alternative embodiment of vacuum cleaner which is similar to the unit of FIGS. 1 to 8 and like parts are given like reference numerals. In this embodiment, the tubular side wall 14 of the cyclone chamber is substantially solid apart from a circumferentially confined region or strip 60 which extends axially of the wall 14 and which is provided with a plurality of apertures or openings 61 that allow air to pass therethrough but which serve to block the passage of particles having a size greater than a pre-determined limit, e.g. 0.4 mm. The region or strip 60 also extends circumferentially in a helical fashion, the helix extending in the opposite helical to the auger 13 and having fewer turns.

The area of the region or strip 60 is small compared with the area of the wall 14 in order to ensure that a significant pressure drop is created between one side of the wall 14 and the other. We have found that the greater the pressure drop across the wall 14, the better the unit functions.

In the present invention, the separated dirt and dust needs to be drawn and held strongly against the wall 14 to resist the general tendency for it to rotate with the auger 13. If the dirt and dust cannot rotate with the auger 13, it will have a greater tendency to be driven downwards by the thread of the auger 13 for collection and compaction.

A vacuum cleaner in accordance with the present invention is simple in construction yet extremely effective in operation and exhibits a greatly increased capacity for holding collected dirt and dust compared with conventional cyclonic vacuum cleaners.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A cyclone separation apparatus for separating matter from a flow of fluid, the apparatus comprising:

a cylindrical cyclone chamber having a tubular side wall;

an inlet disposed at a first end of the chamber for the fluid to be treated;

a region disposed at the second end of the chamber for collecting matter separated from the fluid;

an auger mounted within the chamber for rotation about the longitudinal axis thereof, the auger having a vane which extends both radially of the chamber and longitudinally of the chamber towards the second end thereof in a first helical direction; and means for rotating the auger about the longitudinal axis of the chamber in a direction opposite to said helical direction, wherein the cyclone chamber comprises an end wall at the second end thereof against which the separated matter collects, said end wall being moveable away from said auger to expand the volume of said region in which said collected matter is retained.

2. A cyclone separation apparatus as claimed in claim 1, in which the apparatus is arranged such that fluid flows helically within the chamber between adjacent turns of said helically-extending vane.

3. A cyclone separation apparatus as claimed in claim 1, in which the radially outer edge of the vane engages the internal surface of the tubular side wall of the chamber.

4. A cyclone separation apparatus as claimed in claim 3, in which the radially outer edge of the vane comprises a resilient member biased against the internal surface of the tubular side wall of the chamber.

5. A cyclone separation apparatus as claimed in claim 1, in which one or more apertures or openings are provided in the tubular side wall to form a fluid outlet from the cyclone chamber.

6. A cyclone separation apparatus as claimed in claim 5, in which the tubular side wall forms a filter through which fluid flows radially out of the cyclone chamber.

7. A cyclone separation apparatus as claimed in claim 1, in which said end wall is biased towards the auger and is arranged to move away from the auger against said bias as the region fills with separated matter.

8. A cyclone separation apparatus as claimed in claim 7, in which said end wall is biased towards the auger by a reduced fluid pressure inside said chamber when the apparatus is in use.

9. A cyclone separation apparatus as claimed in claim 1, comprising an outer tubular wall mounted co-axially with the tubular side wall of the cyclone chamber, said end wall being mounted to the outer tubular wall at said second end of the cyclone chamber, the outer tubular wall being moveable axially of the tubular side wall of the cyclone chamber.

10. A cyclone separation apparatus as claimed in claim 5, in which said one or more apertures or openings in the tubular side wall communicate with a space defined between the tubular side wall of the cyclone chamber and a further tubular wall disposed radially outwardly thereof.

11. A cyclone separation apparatus as claimed in claim 10, in which said space conveys fluid from the cyclone chamber to a downstream separation device arranged to remove finer matter from the fluid.

12. A cyclone separation apparatus as claimed in claim 11, in which said downstream separation device is disposed axially outwardly of said first end of the cyclone chamber.

13. A cyclone separation apparatus as claimed in claim 12, in which means are provided for collecting matter separated by said downstream separation device.

14. A cyclone separation apparatus as claimed in claim 13, in which said collection means comprises a duct extending along the central axis of the auger to said second end of the cyclone chamber and arranged so that the matter separated by said downstream separation device is collected in said region together with matter separated in the cyclone chamber.

15. A cyclone separation apparatus as claimed in claim 14, in which a valve is provided for closing said duct.

16. A vacuum cleaner comprising a cyclone separation apparatus for separating matter from a flow of fluid, the apparatus comprising:

a cylindrical cyclone chamber having a tubular side wall;

an inlet disposed at a first end of the chamber for the fluid to be treated;

a region disposed at the second end of the chamber for collecting matter separated from the fluid;

an auger mounted within the chamber for rotation about the longitudinal axis thereof, the auger having a vane which extends both radially of the chamber and longitudinally of the chamber towards the second end thereof in a first helical direction; and means for rotating the auger about the longitudinal axis of the chamber in a direction opposite to said helical direction, wherein the cyclone chamber comprises an end wall at the second end thereof against which the separated matter collects, said end wall being moveable away from said auger to expand the volume of said region in which said collected matter is retained.

17. A vacuum cleaner as claimed in claim 16, in which the apparatus is arranged such that fluid flows helically within the chamber between adjacent turns of said helically-extending vane.

18. A vacuum cleaner as claimed in claim 16, in which the radially outer edge of the vane engages the internal surface of the tubular side wall of the chamber.

19. A vacuum cleaner as claimed in claim 18, in which the radially outer edge of the vane comprises a resilient member biased against the internal surface of the tubular side wall of the chamber.

20. A vacuum cleaner as claimed in claim 16, in which one or more apertures or openings are provided in the tubular side wall to form a fluid outlet from the cyclone chamber.

21. A vacuum cleaner as claimed in claim 20, in which the tubular side wall forms a filter through which fluid flows radially out of the cyclone chamber.

22. A vacuum cleaner as claimed in claim 17, in which said end wall is biased towards the auger and is arranged to move away from the auger against said bias as the region fills with separated matter.

23. A vacuum cleaner as claimed in claim 22, in which said end wall is biased towards the auger by a reduced fluid pressure inside said chamber when the apparatus is in use.

24. A vacuum cleaner as claimed in claim 17, comprising an outer tubular wall mounted co-axially with the tubular side wall of the cyclone chamber, said end wall being mounted to the outer tubular wall at said second end of the cyclone chamber, the outer tubular wall being moveable axially of the tubular side wall of the cyclone chamber.

25. A vacuum cleaner as claimed in claim 20, in which said one or more apertures or openings in the tubular side wall communicate with a space defined between the tubular side wall of the cyclone chamber and a further tubular wall disposed radially outwardly thereof.

26. A vacuum cleaner as claimed in claim 25, in which said space conveys fluid from the cyclone chamber to a downstream separation device arranged to remove finer matter from the fluid.

27. A vacuum cleaner as claimed in claim 26, in which said downstream separation device is disposed axially outwardly of said first end of the cyclone chamber.

28. A vacuum cleaner as claimed in claim 27, in which means are provided for collecting matter separated by said downstream separation device.

29. A vacuum cleaner as claimed in claim 28, in which said collection means comprises a duct extending along the central axis of the auger to said second end of the cyclone chamber and arranged so that the matter separated by said downstream separation device is collected in said region together with matter separated in the cyclone chamber.

30. A vacuum cleaner as claimed in claim 29, in which a valve is provided for closing said duct.

* * * * *